US006540268B2

(12) United States Patent
Pauser

(10) Patent No.: US 6,540,268 B2
(45) Date of Patent: Apr. 1, 2003

(54) CLOSURE DEVICE FOR A CONTAINER AND FURTHERMORE A CONTAINER FITTED WITH THE CLOSURE DEVICE

(75) Inventor: Herbert Berhard Pauser, Darmstadt (DE)

(73) Assignee: PARAT-Werk Schönenbach GmbH +Co. KG, Remscheid (DE)

( * ) Notice: Subject to any disclaimer, the term of this patent is extended or adjusted under 35 U.S.C. 154(b) by 0 days.

(21) Appl. No.: 09/982,046

(22) Filed: Oct. 19, 2001

(65) Prior Publication Data

US 2002/0047278 A1 Apr. 25, 2002

(30) Foreign Application Priority Data

Oct. 19, 2000 (EP) ..... 00122750

(51) Int. Cl.[7] ..... E05C 3/06; E05C 9/16

(52) U.S. Cl. ..... 292/48; 292/3; 292/11; 292/24; 292/26; 292/27; 292/30; 292/44; 292/45; 292/56; 292/97; 292/196; 220/243; 220/244; 220/291; 220/314; 220/523; 220/538; 220/540; 220/780; 220/915.1

(58) Field of Search ..... 292/43, 45, 44, 292/3, 11, 24, 26, 56, 25, 27, 30, 97, 196; 220/523, 538, 540, 243, 244, 780, 291, 314, 915.1

(56) References Cited

U.S. PATENT DOCUMENTS

| | | | | | |
|---|---|---|---|---|---|
| 211,334 | A | * | 1/1879 | Kervin | 292/48 |
| 716,208 | A | * | 12/1902 | Duchemin | 160/267.1 |
| 1,145,541 | A | * | 7/1915 | Binkley | 292/48 |
| RE16,643 | E | * | 5/1927 | Luce | 70/71 |
| 1,655,148 | A | * | 1/1928 | Larson | 312/222 |
| 2,839,912 | A | * | 6/1958 | Corbin et al. | 70/141 |
| 2,905,493 | A | | 9/1959 | Tocchetto | |
| 2,911,247 | A | * | 11/1959 | Corbin | 292/48 |
| 3,135,105 | A | * | 6/1964 | Brody | 70/71 |
| 3,578,368 | A | * | 5/1971 | Dupuis | 292/45 |
| 4,273,368 | A | | 6/1981 | Tanaka | |
| 4,365,490 | A | * | 12/1982 | Manzoni | 70/70 |
| 4,547,006 | A | * | 10/1985 | Castanier | 292/37 |
| 4,677,832 | A | * | 7/1987 | Remington | 70/67 |
| 4,893,849 | A | * | 1/1990 | Schlack | 292/7 |
| 5,601,206 | A | * | 2/1997 | Haas et al. | 220/527 |
| 6,079,585 | A | * | 6/2000 | Lentini | 220/324 |
| 6,334,560 | B1 | * | 1/2002 | Lentini | 224/404 |

FOREIGN PATENT DOCUMENTS

| | | |
|---|---|---|
| EP | 0 006 645 A1 | 1/1980 |
| GB | 2 094 388 A1 | 9/1982 |
| GB | 2 307 268 A1 | 5/1997 |

* cited by examiner

*Primary Examiner*—Robert J. Sandy
*Assistant Examiner*—Carlos Lugo
(74) *Attorney, Agent, or Firm*—Browdy and Neimark, P.L.L.C.

(57) ABSTRACT

A closure device for a container, which possesses a locking element for mutually locking of two container parts when the container is closed. The locking element has first and second locking instrumentalities, which are arranged on the different container parts. By way of an actuating member, which is able to be switched over between a closed position and an open position a first engagement member may be shifted between a locking position and a released position. The open position of the actuating member corresponding to the locking position may be secured by an obstructing member in order to prevent unauthorized unlocking of the container. An opening mechanism renders possible an overriding of the obstructing action and a switching over of the actuating member into the open position.

39 Claims, 15 Drawing Sheets

CLOSURE DEVICE FOR A CONTAINER AND FURTHERMORE A CONTAINER FITTED WITH THE CLOSURE DEVICE

BACKGROUND OF THE INVENTION

The invention relates to a closure device for a container, as for example a travelling case or a tool case, comprising a locking means for the releasable mutual locking of the two container parts when the container is closed, said locking means having first locking instrumentalities for the first container part and second locking instrumentalities for the second container part, the first locking instrumentalities including at least one actuating member able to be switched over between an open position and a closed position, said actuating member being kinematically coupled with at least one engagement member of the first locking instrumentalities, which in the open position of the actuating member can assume released position out of locking engagement with a second engagement member of the second locking instrumentalities and in the closed position of the actuating member can assume a locking position in locking engagement with the second engagement member.

Furthermore, the invention relates to a container fitted with such a closure device.

THE PRIOR ART

Such a closure device with an associated container is disclosed in the German patent publication 3,142,588 C2 and the German patent publication 3,153,422 C2. In this case a container is provided, which has two moving container parts able to be to be moved relatively toward one another and which when the container is closed are superposed. The closed container can be releaseably locked, for which purpose a locking means is provided, which has first and second locking instrumentalities arranged on the two container parts and which may be brought into engagement with each other.

The first locking instrumentalities provided on the first container part possess two pivotally mounted, hooked first engagement members resiliently urged into a locking position. On closing the container second engagement members provided on the second container part snap into the first engagement members. For opening the container a slide is operated diverting the first engagement members against the resilient force into a released position so that the second engagement members may be lifted or drawn out for opening the container.

Since in the case of the known closure device the locking action is only ensured by the resilient effect due to the pivotal first engagement members, damage to such resilient means can lead to an unintended opening of the container.

An analogous structure with similar problems is to be found in the case of the designs of closure devices disclosed in the European patent publication 0 017 539 A1, the European patent publication 0 006 645 B1, the German patent publication 2,166,699 A1 and the European patent publication 0 018 106 A1.

SHORT SUMMARY OF THE INVENTION

One object of the invention is to provide a closure device for a container which is reliable in its function.

A further object of the invention to suggest a container provided with such a closure device.

In order to achieve these and/or other objects appearing from the present specification, claims and drawings, in the present invention in the case of a closure device of the type initially mentioned the second locking instrumentalities comprise at least one obstructing member extending, when the locking instrumentalities are united together, into the path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position.

The object is furthermore achieved by a container fitted such a closure device.

Accordingly the locking position of the at least one engagement member is secured mechanically in its locking position, such engagement member belonging to the first locking instrumentalities, such mechanical securing action being achieved by an obstructing member belonging to the second locking instrumentalities. This means that there is an automatic obstruction in the locking position when the locking instrumentalities are united, that is to say when the container is closed, and an accidental switching back out of the closed position into the released position is prevented when container is in its closed state. In the obstructed position the obstructing member cooperates with an abutment part, which is either formed directly by the actuating member cooperating with the engagement member or is in the form of a separate component which is however kinematically coupled with the actuating member. For opening the closed and accordingly secured container an opening mechanism is provided, with which the obstructing action of the actuating member can be overridden and by means of which it is possible to ensure that the actuating member associated with the abutment part may be switched back into the open position so that the associated first engagement member is also moved out of the locking position, so far assumed, into the released position.

Further advantageous developments of the invention are defined in the claims.

The opening mechanism preferably comprises an adjustable opener which possesses a ramp or deflecting face by means of which such an action may be exerted on the abutment part that same undergoes deflection in relation to the obstructing member and accordingly is able to move past the obstructing member to the side so that the actuating member is now able to switch over into the open position. The deflecting face may for example be an oblique face, which on increasing displacement of the opener with little force causes a gradual deflection of the abutment part. Preferably, the abutment part is biased by spring means into a non-deflected position so that it may automatically return to this position when it is not held in the deflected position actively.

It would in principle also be possible to provide spring means, which after the obstructing action has ceased automatically move the actuating member into the open position and accordingly move the first engagement member, which is kinematically coupled with the actuating member, into the released position. However, for the purpose of obtaining a particularly high degree of operational reliability it is preferred to provide the opener additionally with an impingement or strike face using which, on manually produced movement of the opener can ensure an active impingement of the deflected abutment part in such a manner that same is actively or positively moved past the obstructing member. The adjustable opener accordingly ensures not only the deflection of the actuating member but also the switching over into the open position.

The at least one obstructing member is preferably lug-like in design and so arranged that it projects past the first locking instrumentalities.

In the case of a further advantageous design there is a provision such that, on the side facing the second locking instrumentalities, the first locking instrumentalities possess a terminal face defined for instance by the outer face of a bar of constant cross section, which terminal face covers over the locking mechanism and behind which the at least one first engagement member is set back in the released position, each first engagement member being provided with a recess in the terminal face for it, through which it can extend on assuming the locking position. It is in this manner that it is possible to ensure that the first engagement member does not project in an interfering fashion when in the released setting thereof, but is lowered into a protected position which even in the case of a hooked design will prevent injury to the person using the container fitted with the closure device.

Preferably, at least the released position of the at least one first engagement member is held by spring means and preferably by means of a resilient action on the actuating member kinematically_coupled with the engagement member. More particularly in this connection it is particularly advantageous, if the at least one locking member has a double function and also assumes the function of an actuating member, which on closing the container acts on the abutment part located in the open position and switches it over into the closed position, where, owing to the obstructing action, it prevents accidental switching back of the abutment part.

It is also possible to provide spring means, which cause a resilient holding of the actuating member in the closed position, a design being particularly preferred, in the case of which spring means causing a bistable holding action are present and which are able to hold both the open position and also the closed position and which on actuation render possible a transition between these positions with a snap or detent action.

One advantage of the closure device is furthermore that the at least one obstructing member and the at least one second engagement member may be designed as independent components of the second locking instrumentalities so that the corresponding components may be designed specifically as regards the individually performed functions.

There is the possibility of fitting the first locking instrumentalities of the closure device with only one actuating member and the associated first engagement member. This design is particularly preferred in the case of small containers. More particularly in the case of large containers it is however appropriate to lock the parts of the closed container at several separate points and in such cases it is convenient to provide a plurality of locking units each comprising at least one actuating member and at least one first engagement member, which functionally are more particularly so ganged together that they operate synchronously, something which may for example be ensured if all locking units possess a common opening mechanism.

There is the possibility of connecting a plurality of locking units together in series directly, the opening mechanism only being provided for one actuating member and the next coupled actuating member being activated by the movement of the first actuating member.

There is moreover the possibility of placing two locking units side by side and of arranging the opening mechanism centrally in the region between them so that it can simultaneously cooperate with the two locking units.

If there are several locking units, there is the possibility of having a symmetrical arrangement with an equal length of the actuating members and also the possibility of having an asymmetrical arrangement with actuating members of different length. The latter arrangement leads to a particularly flexible adaptation to different container dimensions.

Although in principle it would be possible to design the at least one actuating member in the form of a plain slide, specific advantages are to be had with a design, in which the actuating member is designed in the form of a pivotally mounted lever, whose first lever arm cooperates with a first engagement element and whose second lever arm is provided with an abutment part. The switching over motion of the actuating member is in this case a sort of rocking movement, something which offers the advantage that, unlike the case of a sliding movement, the overall length of the first locking instrumentalities may be made relatively small so that closure device only requires a small amount of space. Furthermore, it is possible to do without complicated sliding bearing means, since it is possible to have recourse to a pivot bearing which is simpler to design.

If two locking units are provided, whose actuating members are each designed on the basis of the pivoting lever as described, it is preferred to provide a kinematic coupling so that between the two second lever arms, which are adjacent to one another, of the actuating members coupling means simultaneously acting on such two second lever arms are provided, which during the synchronous switching over movement of the actuating members perform a translatory movement in the plane of pivoting. These coupling means may constitute an abutment part associated with both actuating member alike, such abutment part being able to cooperate with an obstructing member so that using only one obstructing member both actuating members can be locked in the closed position.

Alternatively or additionally it is possible for the coupling means to also comprise spring means, which are in between and bear against the two second lever arms and accordingly simultaneously bias the actuating member respectively into the open position or into the closed position.

For the activation thereof the opening mechanism preferably comprises a manually operated opener, which for example may be in the form of a thrust member or of a rotary part with an eccentric. In the case of a particularly preferred simple but functionally reliable modification the opener is designed like a slide and for acting on the abutment part is able to be shifted in a working plane, which coincides with the pivot plane of the actuating member or extend in parallelism thereto.

In order to prevent unauthorized access to a container fitted with a closure device the container may comprise a catch means including a number lock. The lock will then preferably cooperate with the opening mechanism, for example in such a manner that it prevents the actuation of a moving opener of the opening mechanism.

Further advantageous developments and convenient forms of the invention will be understood from the following detailed descriptive disclosure of embodiments thereof in conjunction with the accompanying drawings.

LIST OF THE SEVERAL VIEWS OF THE FIGURES.

DETAILED ACCOUNT OF WORKING EMBODIMENTS OF THE INVENTION

Figure 1:
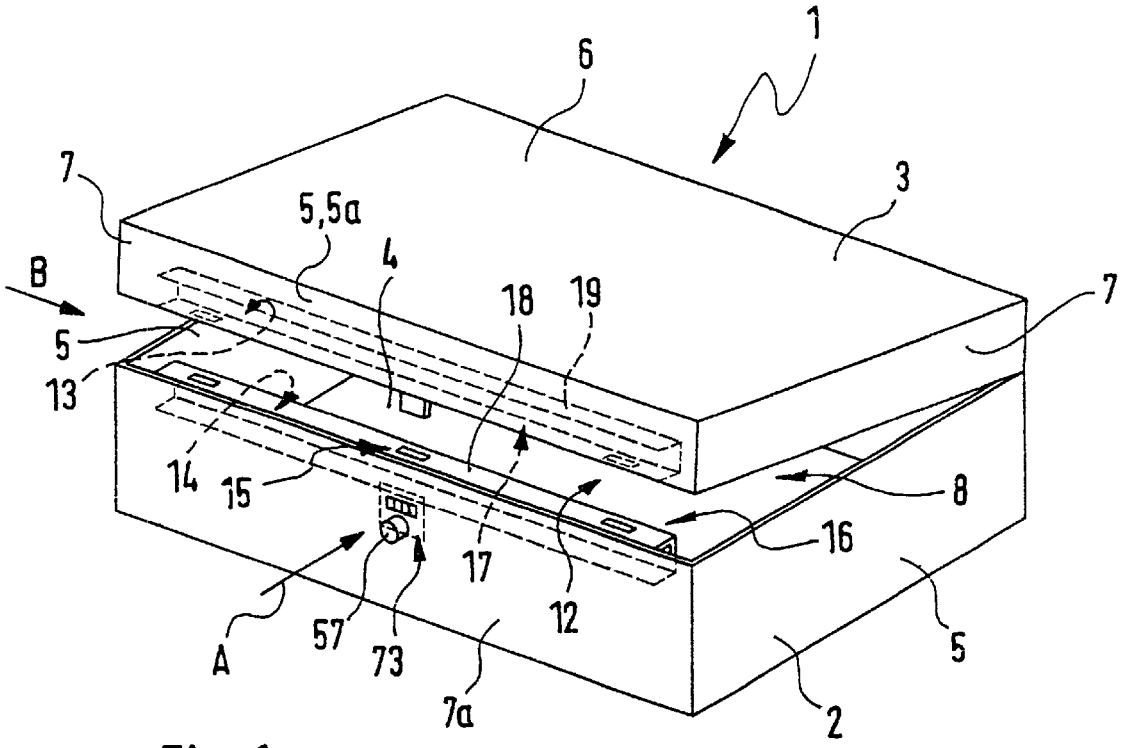
FIG. 1 is a perspective diagrammatic representation of a partly opened container, which is fitted with a preferred design of the closure device in accordance with the invention.

FIG. 1 shows a container 1 which is for example in the form of a valise or a tool chest and which comprises a first container part 2 and a second container part 3. In the working embodiment illustrated the two container parts 2 and 3 are each designed in the form of shells, the sharp edges shown in the drawing being rounded off if desired.

The first container part 2 constitutes a bottom container part with a floor wall 4, having a rectangular plan and from whose edges in all four first side walls 5 extend away to the same side.

In the working embodiment illustrated the second container part 3 defines the top container part, which has a top wall 6 corresponding to the plan of the floor wall 4 and fourth second side walls extending away to the same side.

The side walls 5 and 7 are only partly visible. The container parts 2 and 4 are so arranged in relation to each other that when the container is closed the first and the second side walls 5 and 7 face each other and have their free edges in engagement in a flush fashion. It is in this manner that the two container parts 2 and 3 delimit an inner space 8 of the container.

The two container parts 2 and 3 are connected together by hinge means, not illustrated, on the side walls 5 and 7 so that same may be moved in relation to each other in order to selectively have a closed or open state of the container. FIG. 1 shows one possible open condition of the container wherein the two container parts 2 and 3 are however very close together so that the access opening 12 available for interior 8 of the container is relative small in size.

Furthermore, the container 1 will possess suitable handling means, as for example one or more carrying grips and/or casters, which are however not illustrated in detail here.

The further course of the description will be based on a design of the container 1, wherein the second container part 3 placed at the top functions as a lid, which is pivoted upward and downward for opening and closing the container 1.

When the container 1 is closed and the front first side walls 5*a* and 7*a* of the two container parts 2 and 3 are directly adjacent to each other at their longitudinally extending edges, their inner faces 13 and 14 possibly lying in a common plane, at least in the zone of abutment between them. These front first and second walls 5*a* and 7*a* have a closure device generally referenced 15, which renders it possible to lock the two container parts 2 and 3 in the closed state of the container together in a detachable manner to prevent accidental opening.

The closure device 15 comprises a locking means with first locking instrumentalities 16 arranged on the first container part 2 and second locking instrumentalities 17 arranged on the second container part 3, which instrumentalities can cooperate together. Conveniently, the locking instrumentalities 16 and 17 are respectively secured to the inner face 13 and 14 of the associated front first and, respectively, second side walls 5*a* and 7*a* in the edge region of the respective side wall facing the respectively other container part.

In the working embodiment illustrated the first and the second locking instrumentalities 16 and 17 are designed in the form of an assembly, which by means of attachment means (not illustrated) may be extremely simply mounted on the respective container part 2 and 3.

In this respect the first and the second locking instrumentalities 16 and 17 respectively possess an elongated first and, respectively, second beam 18 and 19 conveniently constituted by a bar of constant cross section, such beam serving for the attachment on the respective container part and bearing and/or containing at least the larger part and, preferably all, of the components of the respective locking instrumentalities.

The two beams 18 and 19 in the working embodiment have a U-shaped cross section and are mounted on the inner face 13 and 14 of the front side walls 5*a* and 7*a* with the open longitudinal side to the fore so that a gap-free, closed impression is created and all moving part may be accommodated in the inner space 22 of the beam so that damage to articles placed in the container 1 is avoided.

On the side facing the second locking instrumentalities the first locking instrumentalities 16 are delimited by a terminal face 23, which is constituted by the correspondingly aligned outer face of the first beam 18. Opposite to it there is limiting face 24 provided on the second beam 19, which limiting face is spaced to a greater or lesser extent from the terminal face 23 when the container is open, whereas when the container is closed however it is adjacent to the terminal face 23 or comes into engagement therewith.

In the working embodiment illustrated the first locking instrumentalities 16 comprise two adjacently placed and spaced apart locking units 25*a* and 25*b* extending in the longitudinal direction of the first beam 18 and, respectively, of the associated first side wall 5. Each of such locking units 25*a* and 25*b* is provided with a first engagement member 26*a* and 26*b*, which is rotatably mounted on the first beam 18 for turning about a pivot axis 27*a* and 27*b*.

For each first engagement member 26*a* and 26*b* of the first locking instrumentalities 16 a second engagement member 28*a* and 28*b* is provided belonging to the second locking instrumentalities 17. In the state already for cooperation of the two locking instrumentalities 16 and 17, which is indicated in FIGS. 5 and 12, the first and the second engagement members 26*a* and 28*a* and furthermore 26*b* and 28*b* are opposite to each other in the opening and closing direction 32 of the container parts 2 and 3 indicated by the double arrow.

Figure 2:
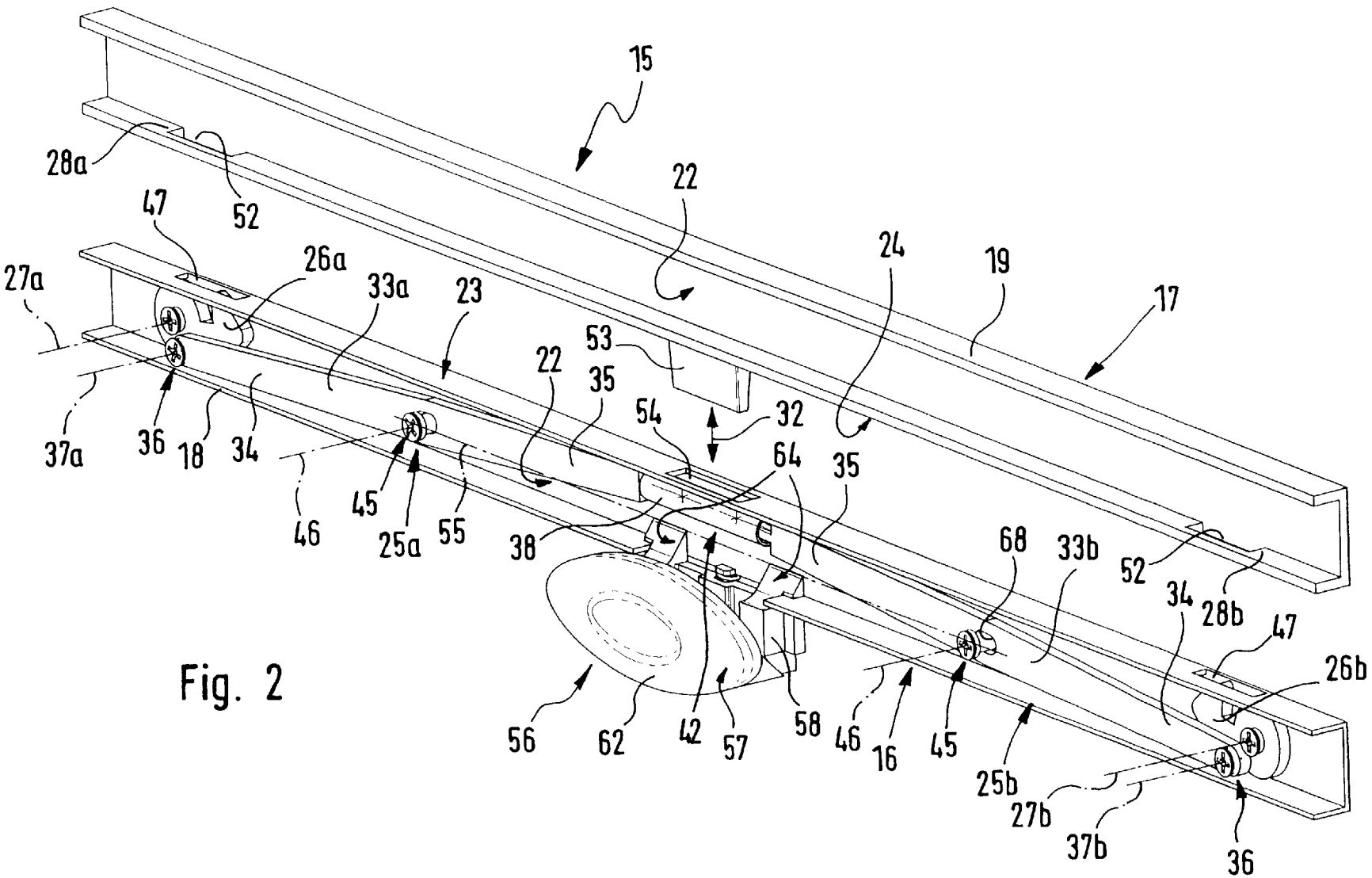
FIG. 2 shows the closure device using in the container of FIG. 1 separately and on a larger scale in perspective looking in the direction of arrow A in FIG. 1 with the container opened and with the locking instrumentalities separated.
Figure 3:
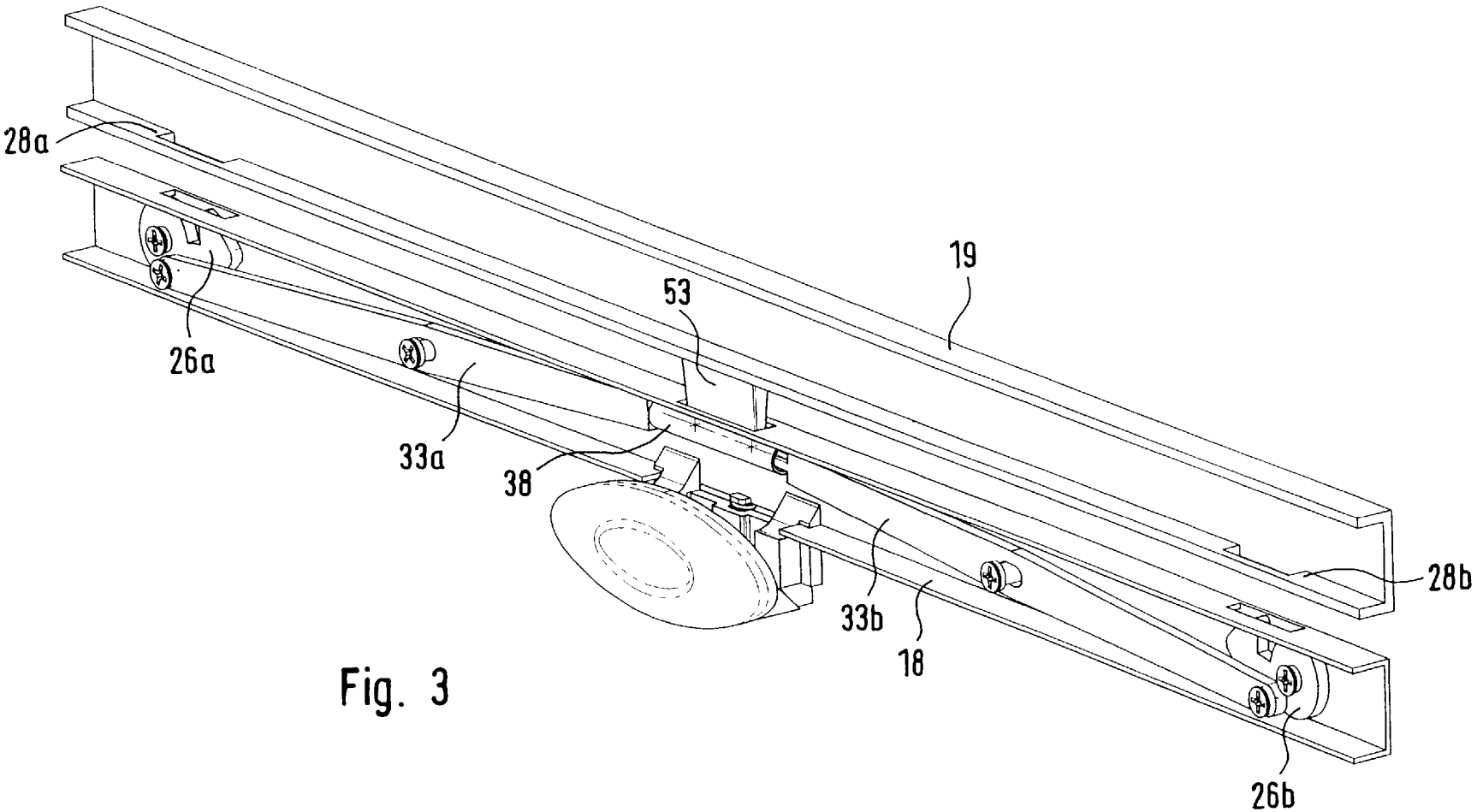
FIGS. 3 and 4 show different phases of the closing action of the closure device during closing of the associated container in a manner of representation as in FIG. 2.
Figure 4:
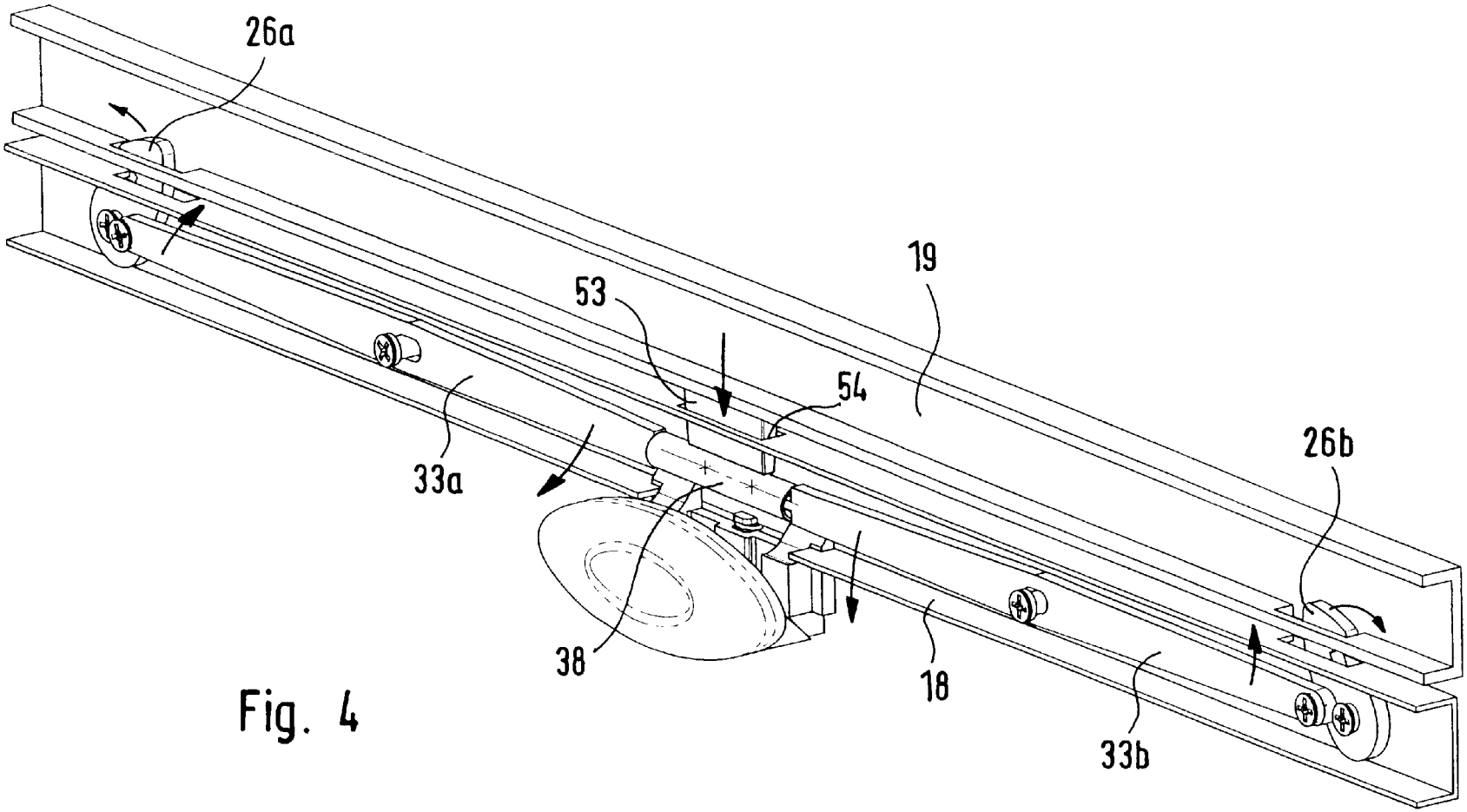
Figure 5:
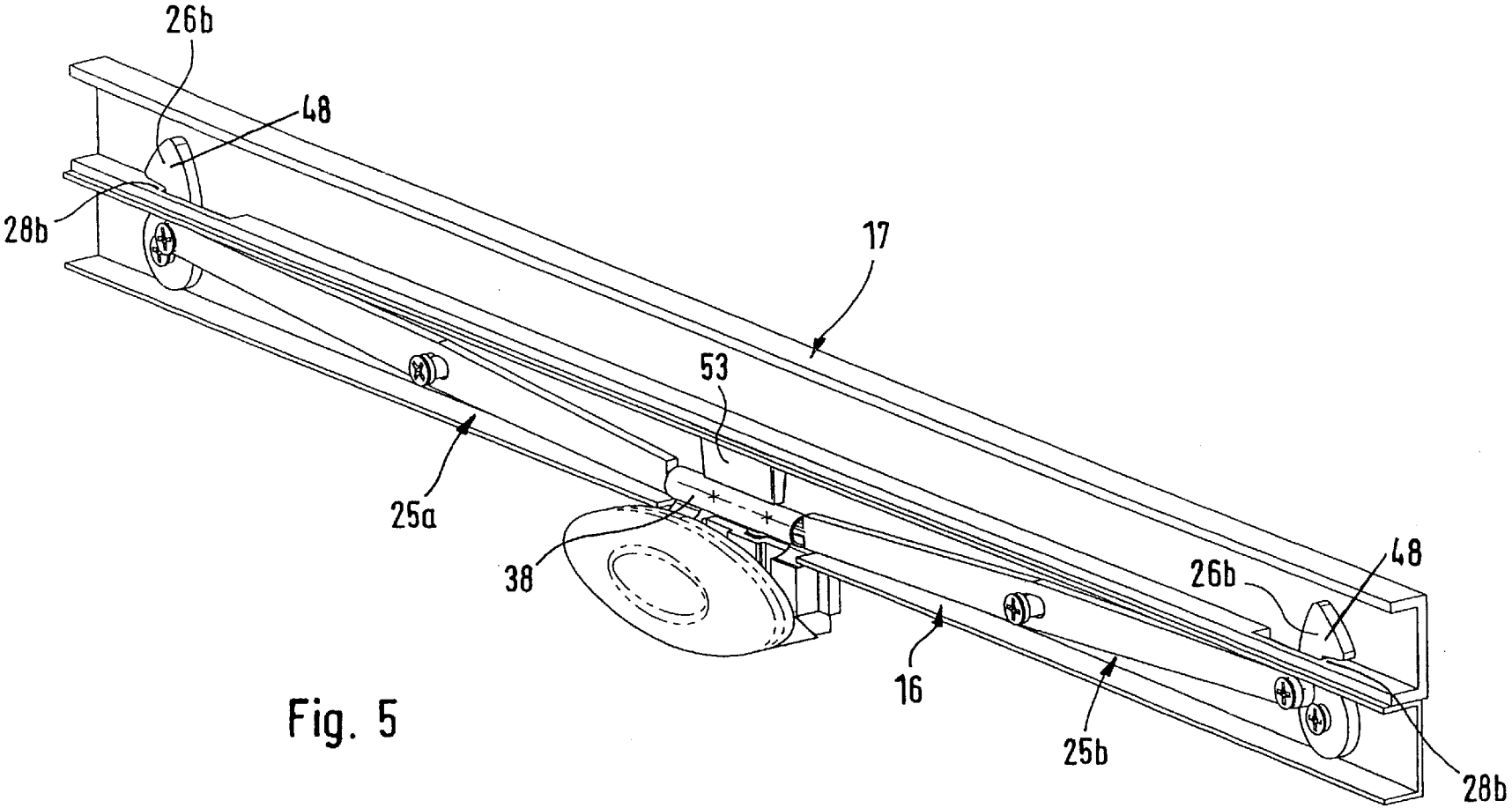
FIG. 5 shows a similar view in the locked condition of the closure device with the container closed and with the locking instrumentalities locked together.
Figure 12:
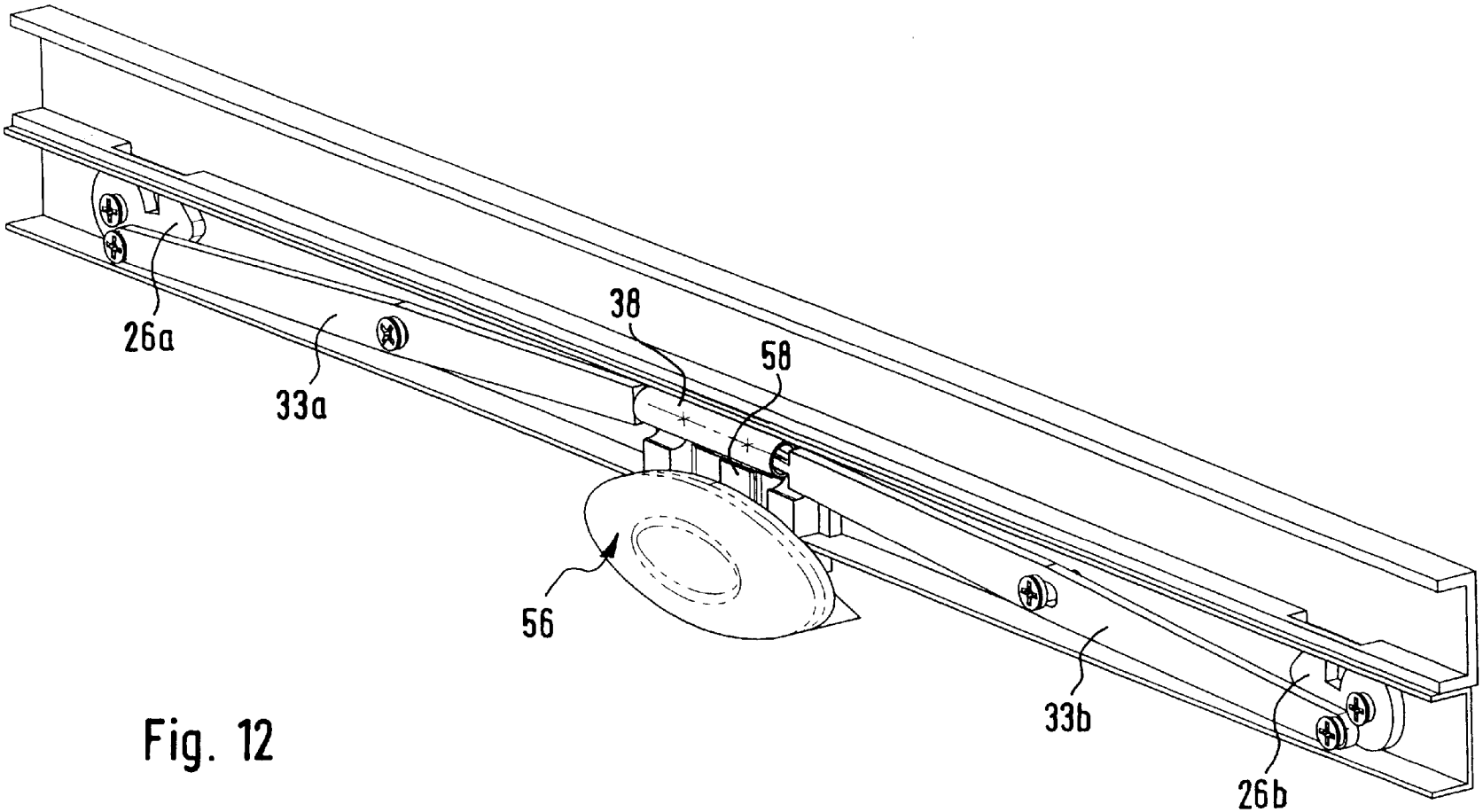
FIG. 12 shows in a similar fashion the unlocked state of the closure device prior to separation of the united locking instrumentalities, this corresponding to a condition of the container which is still closed and if required is to be opened.

Each first engagement member 26*a* and 26*b* is engaged by an elongated actuating member 33*a* and 33*b*, by way of which a setting force can act on the associated one engagement member 26*a* and 26*b* in order to pivot the latter between a released position indicated for instance in FIGS. 2 and 12 and a locking position illustrated in FIG. 5.

The two actuating members 33*a* and 33*b* are in the working embodiment designed in the form of pivotally mounted two-armed levers, the first lever arm 34 thereof engaging the associated first engagement member 26*a* and 26*b* more particularly at the end thereof. The point 36 of engagement is designed to permit a pivoting action and is located at a radial distance from the axis 27*a* and 27*b* of rotation, a further axis 37*a* and 37*b* respectively parallel to these axes 27*a* and 27*b* of rotation being defined.

For the second lever arm 35 of each actuating member 33*a* and 33*b* there is an abutment part 38. Same could in principle be constituted directly by the associated actuating member 33*a* and 33*b*, and therefore could for instance be designed as a single structural unit with the second lever arm 35 of the actuating member 33*a* and 33*b*. In the working embodiment however a different design is selected, in the case of which the abutment part 38 is a component separate from the actuating members 33*a* and 33*b*, although there is a kinematic coupling with these actuating members 33*a* and 33*b*. This kinematic coupling is such that setting forces exerted on the abutment part are transmitted to the associated actuating member 33*a* and 33*b*.

Each actuating member 33*a* and 33*b* could have only one abutment part 38 associated with it. In the working embodiment on the other hand only one abutment part 38 is provided, which simultaneously is coupled kinematically with the two actuating members 33*a* and 33*b*. In accordance with FIG. 2 coupling means 42 extend between the second adjacent locking units 25*a* and 25*b*, which at the same time engage the two second lever arms 35, such coupling means 42 having the single abutment part 38.

The abutment part 38 can here for example be constituted by a sleeve body, which is slipped onto the second adjacent terminal sections of the second lever arms 35 with axial and radial play. The lever arms 35 may here possess receiving pins 43 fitting into the abutment part 38.

The coupling means 42 preferably furthermore comprise a spring means 44 which are placed between and bear against the second lever arms 35. In the working example the spring means 44 are constituted by a helical compression spring, which is seated concentrically in the interior of the sleeve-like abutment part 38 and is fitted on the receiving pin 43 for centering.

Both actuating members 33*a* and 33*b* are pivotally mounted on the first beam 18. The point of pivotable bearing 45 is preferably so placed that the two lever arms 34 and 35 extending from this point are of equal length. However, unequal lengths of the lever arm are possible. The respective pivotale bearing point 45 defines a pivotal axis 46, which extends in parallelism to the above mentioned axes of rotation.

Figure 6:
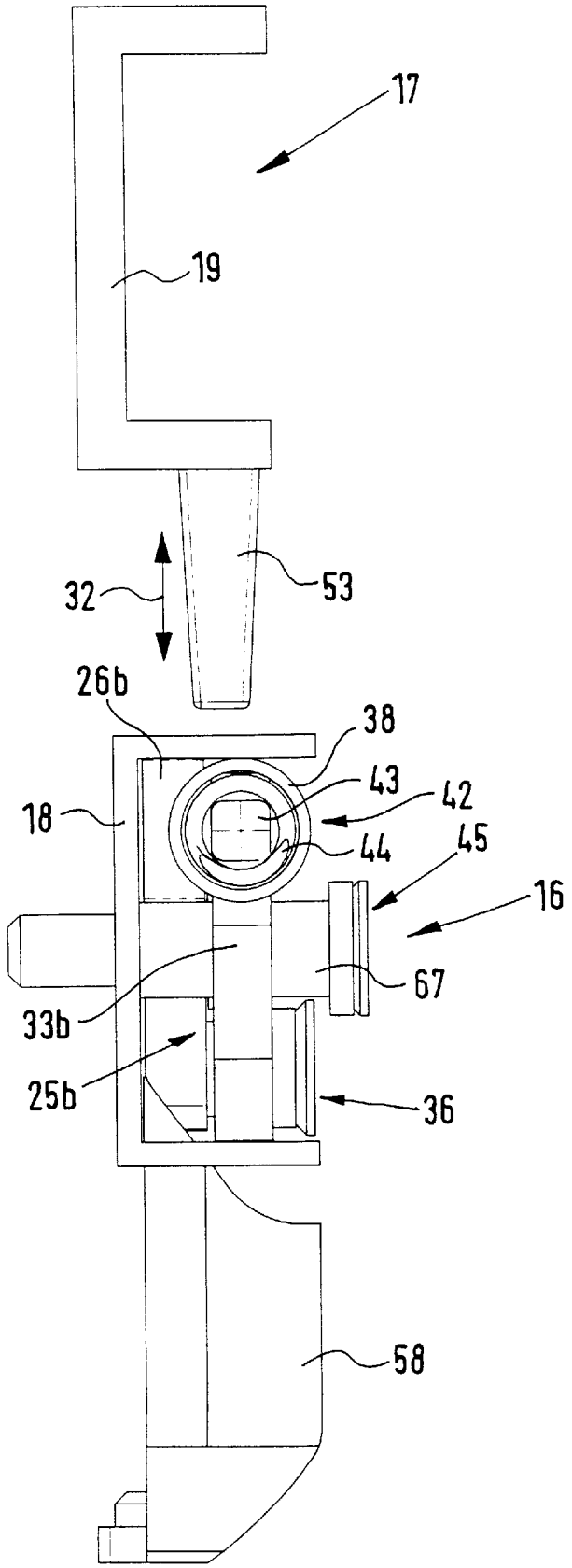
FIGS. 6 to 9 show the closure device of FIG. 1 to separately indicate an end-on view as indicated by the arrow B of FIG. 1 omitting the container, the representations corresponding to the states of FIGS. 2 through 5, the locking unit to the fore being omitted in order to make the drawing more straightforward.
Figure 7:
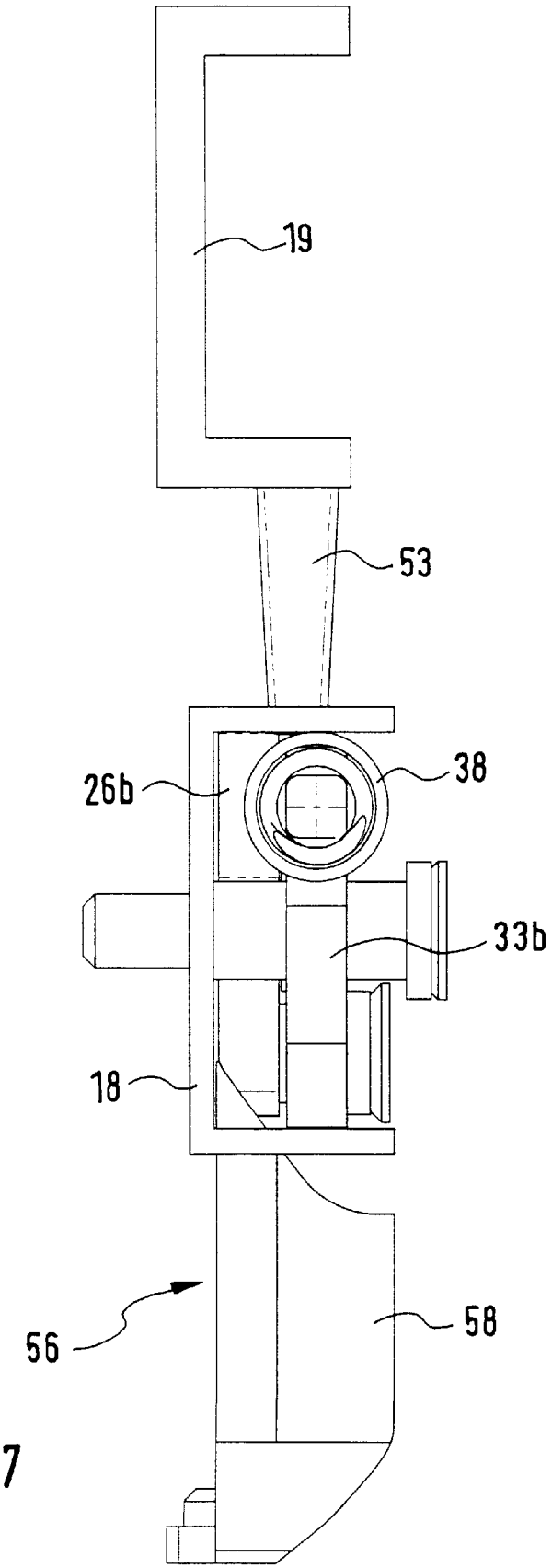
Figure 8:
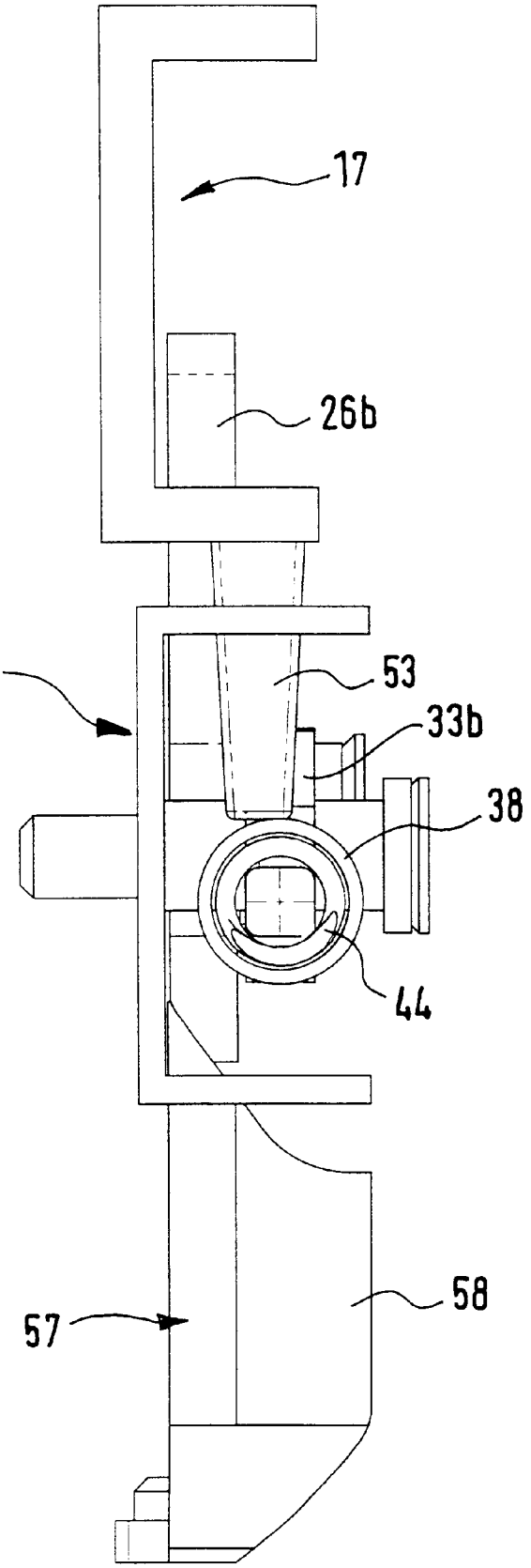
Figure 9:
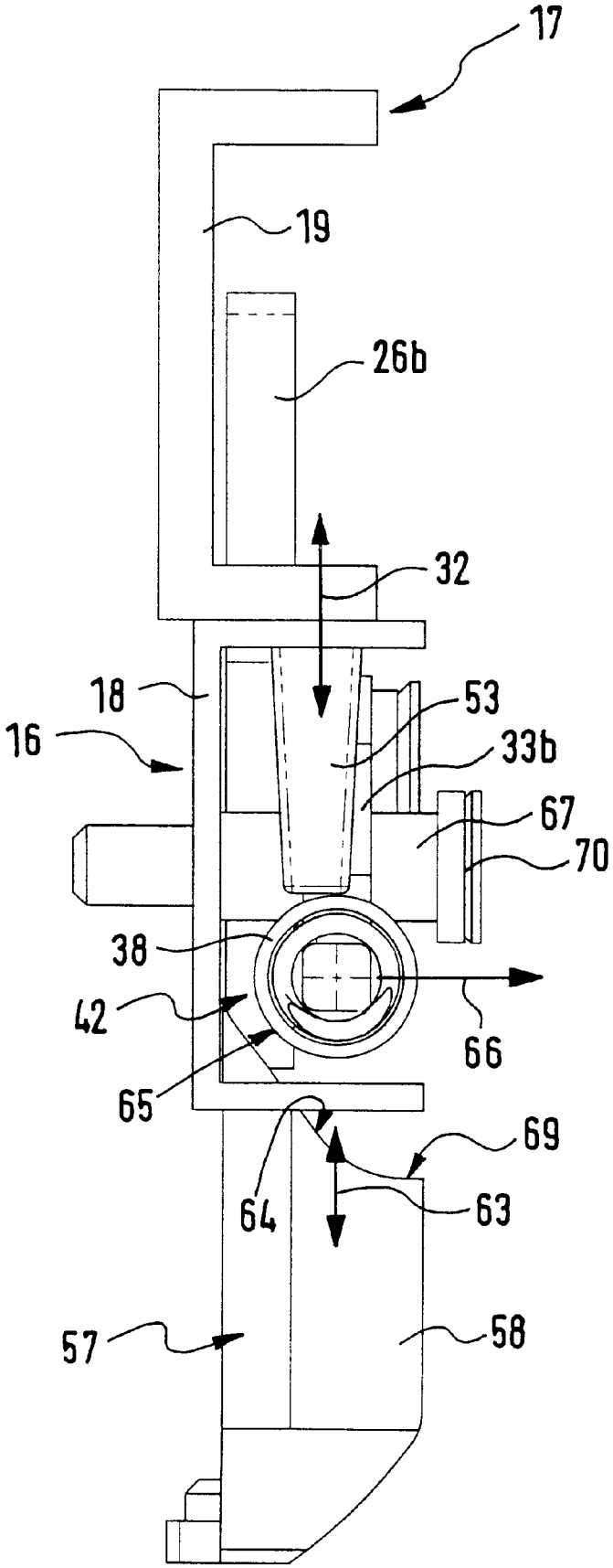

By the application of a suitably directed force on the abutment member 38 two actuating members 33*a* and 33*b* may to be switched over as part of a pivoting movement in relation to the pivot axis 46 between an open position indicated for instance in FIGS. 2 and 6 and a closed position indicated for instance in FIGS. 5 and 9.

Since the actuating members 33*a* and 33*b* have their first lever arm 34 in engagement with the first engagement members 26*a* and 26*b*, each position of an actuating member 33*a* and 33*b* is associated with a predetermined position of the coupled first engagement member 26*a* and 26*b*. In the open position of an actuating member 33*a* and 33*b* the associated first engagement member 26*a* and 26*b* assumes a released position, whereas the closed position in the actuating member 33*a* and 33*b*corresponds to a locking position of the associated first engagement member 26*a* and 26*b*. The transition between the released position and the locking position of the first engagement members 26*a* and 26*b* takes place as part of a pivoting motion about the axis 27*a* and 27*b* of rotation. The locking mechanism, comprising the two locking units 25*a* and 25*b*, of the first locking instrumentalities 16 is accommodated together with the abutment part 38 in the interior 22 of the first beam 18 and is covered over by the terminal face 23. Each first engagement member 26*a*and 26*b* is however provided with a recess 47 in the terminal face 23 which in the working embodiment extends through the U limbs of the first beam 18 and which renders it possible for the first engagement member 26*a* and 26*b* to extend through it.

In the released position the first engagement members 26*a* and 26*b* are moved back behind the terminal face 23 and thus assume a lowered position in relation to the terminal face 23 so that there is no danger of injury on the projecting sharp edges. On transition into the locking position the first engagement member 26*a* and 26*b* will partially extend through the recess 47 until its arrives in the locking position.

During this operation the first engagement member 26*a* and 26*b* has the possibility of fitting behind the second engagement member 28*a* and 28*b* as in FIG. 5, such member 28 having drawn close. It is in this manner that the two locking instrumentalities 16 and 17 are firmly locked together and the opening of a respective container 1 prevented. The locked state then assumed by the closure device 15 generally is indicated in FIG. 5.

The first engagement members 26*a* and 26*b* are in the working embodiment designed in the form of hooks and in the locked position have a hooked section 48 fitting through the respectively associated recess 47. The second engagement members 28*a* and 28*b* are constituted by the edge of an aperture 52 in the second locking instrumentalities 17, which is formed in the opposing face 24 and extends through the associated U-limb of the second beam 19. In the locked state as illustrated in FIG. 5 the hook sections 48 of the first engagement members 26*a* and 26*b* can fit through the apertures 52 and fit behind the edge of such aperture.

The second locking instrumentalities 17 comprise an obstructing member 53, which can, when the container 1 is closed and accordingly the locking instrumentalities 16 and 17 are united, extend into the path of displacement of the abutment part 38 and to hold the actuating members 33*a* and 33*b* in the closed position.

This condition appears from FIG. 5. In this manner a reliable mechanical means is provided for preventing accidental unlocking, the securing function being exerted automatically by the second locking instrumentalities 17 and, respectively, their obstructing member 53 and accordingly is dependent on whether the associated container is open or closed or, respectively, whether the locking instrumentalities 16 and 17 are united with each other or are separated from one another. In order to produce the securing function, closing of the container is all that is required, and no additional handling operation is necessary.

Instead of simply having an obstructing member it would also be possible to have a plurality of obstructing members. This would more particularly be appropriate when each locking unit 25*a* and 25*b* has its own abutment part and accordingly it is necessary to jam a plurality of abutment parts simultaneously.

In what follows an account will be given of the locking operation automatically started on closing the container starting with the container in its open state as illustrated in FIG. 2. Here details will be given of further design features of the closure device.

In the open state of the container the actuating members 33*a* and 33*b* will normally assume the open position indicated in FIG. 2, such open position involving a simultaneous assumption of the release position of the first engagement members 26*a* and 26*b* kinematically coupled with the actuating members 26*a* and 26*b*. The above mentioned spring means 44 cause this state to be held, since they exert a rotary torque into the open position on the actuating members 33*a* and 33*b* like a pivoting lever. As a counter-abutment for the spring force use is made of suitable support face, which are more particularly constituted by the first beam 18, and more especially by the inner face of the first beam 18 opposite to the terminal face 23.

On closing the container 1 the obstructing member 53 moves in the opening and closing direction 32 closer to the first locking instrumentalities 16 and finally fits through through an aperture 54. The aperture 54 is formed in the terminal face 23 in a region opposite to the abutment part 38.

This means that the obstructing member 53 is in a position of exerting a setting force on the abutment part 38, which produces a torque effective at the actuating members 33*a* and 33*b* to produce a switching over into the closed position. The actuating members 33*a* and 33*b* are accordingly simultaneously pivoted gradually into the closed position, the first engagement members 26*a* and 26*b* simultaneously being pivoted toward the locking position, same being able to fit into the approaching apertures 52 of the second beam 19 and finally to fit behind the second engagement members 28*a* and 28*b* with a locking action.

The above mentioned movements are indicated in FIGS. 2 through 5 and, respectively, 6 through 9.

The arrangement of the working example is such that the two second lever arms 35 are, in the open position and in the closed position, on opposite sides of an imaginary connecting line 55 between the pivot bearing points 45. In the open position they are on the side facing the obstructing member 53 of such connecting line 55. The result of this is that during the transition between the two end positions and on moving past the connecting line 55 the spring means 42 move through a dead center position of maximum compression. This leads to a snap-action effect with a bistable resilient holding of the actuate members 33*a* and 33*b*, which are accordingly held both in the open position and also in the closed position with the supporting action of a spring.

In connection with the spring means it is however to be noted that in case of need same can be placed at some other point so that they are effective between the first beam 18 and a respective actuate member 33*a* and 33*b*. It would be feasible as well to provide spring means for the respective actuating member 33*a* and 33*b* adjacent to a respective pivot bearing point 45.

Once the container is in the locked condition as shown in FIG. 5, the obstructing member 53 will still be on the path of displacement, defined by the possible pivotal movement, of the abutment part 38 and will prevent the member 53 being switched back into the open position.

In the case of the above explained switching over operation the abutment part 38 or, respectively, the coupling means 42 comprising same, will perform a translatory linear movement, whose direction is preferably the same as that of the opening and closing movement 32 which simultaneously defines the direction of plunging of the obstructing member 53 into the aperture 52. Owing to the above mentioned radial and axial play the changes in position of the second lever arm 35 bearing the abutment part are compensated for.

At the opposite face 24 the obstructing member 53 is arranged on the second beam 19 from which it projects toward the first beam 18. Preferably, it is lug-like or pin-like in configuration. The obstructing member is preferably in the form of an independent component separate from the second engagement members 28*a* and 28*b*, which only performs an actuating and obstructing action without taking part in the locking operation as such.

Supposing that the first engagement members 26*a*and 26*b* are for some reason or other in the locking position even prior to the closing of the container 1, while at the same time the actuating members 33*a* and 33*b* are in the closed position, closing of the container will still be possible. Owing to the resilient action on the actuating members 33*a* and 33*b* it is possible for the first engagement members 26*a* and 26*b* to be shifted a little way toward the released position because due to the action of the approaching second engagement members 28*a* and 28*b* during the closing operation and after moving past the second engagement members 28*a* and 28*b* they snap back into the locking position of their own accord. For this the locking member 53 is not necessarily needed as a means having a loading action, even although it may still perform the function of a support member or, respectively, holding down means, for the spring means 42.

For unlocking the locking instrumentalities 16 and 17 locked together when the container 1 is closed an opening mechanism 56 is provided, which is conveniently a component of the first locking instrumentalities 16 and serves to override the jamming, caused by the obstructing member 53, of the actuating members 33*a* and 33*b* and to switch over the latter into the open position, while at the same time unlocking the first engagement members 26*a* and 26*b*, which are kinematically coupled with the actuating members 33*a* and 33*b*.

In the working embodiment illustrated the opening mechanism 56 cooperates simultaneously with the two locking units 25*a* and 25*b*, it being provided for the area lying between such locking units 25*a* and 25*b* so that there is central actuating means or possibility. As compared with a design, which would be possible in principle, with independent opening mechanisms for each locking unit 25*a* and 25*b*, the joint arrangement also offers the advantage of a reduction in the complexity of manufacture and of the space requirement.

The opening mechanism 56 comprises an adjustable opener 57, which has an activating member 58, located in the fitted condition in the interior 8 of the container, and furthermore a control member 62, for example in the form of an actuating button. Between the activating member 58 and the control member 62 there is a firm or permanent connection through the front first side wall 5*a* (not illustrated), which may be slotted for this purpose. By taking hold of the control member 62 from the outside it is thus possible for the opener to be operated in the desired manner.

Considering the closure device 15 in the locked state the activating member 58 is on the side, which is opposite to the obstructing member 53, of the abutment part 38 (see FIG. 9). The opener 57 is preferably designed in the form of a slide and may be shifted by acting on the control member 62 linearly in an activating direction coinciding with the opening and closing (activation) direction 63. Then the activating member 58 moves in a plane here termed a working plane, which coincides with or is parallel to, planes of pivoting of the actuating members 33*a* and 33*b* and the plane of motion of the first engagement members 26*a* and 26*b*.

The activating member 58 has a ramp or deflecting face 64 on the side facing the abutment part 38 and such face 64 preferably extends obliquely at least in part in relation to the activation direction 63. If the activating member 58 is shifted out of the deactivated position illustrated in FIG. 9 toward the abutment part 38 the deflecting face 64 will touch a lateral strike area 65 turned in a direction perpendicular to the direction of switching over, of the abutment part 38 and will deflect same in relation to the obstructing member 53 in a direction perpendicular to the plane of pivoting of the actuating members 33*a* and 33*b*. The deflecting movement is indicated by the arrow 66.

The path of possible deflecting motion is of such a size that the deflected abutment part 38 is completely or at least to a major extent moved out of the area in front of the obstructing member 53.

This deflection movement is ensured because on the one hand the connection of the actuating members 33*a* and 33*b* with the first engagement members 26*a* and 26*b* on the points 36 of action and on the other hand the pivot bearing function at the pivot bearing 45 are designed with suitable degrees of freedom, more particularly by ensuring a sufficient degree of play or by having suitably designed joints.

Thus for example the bearing pin 67 attached to the first beam 18 and defining the point 45 of pivot bearing, is of such a length as makes it possible for the actuating members 33*a* and 33*b* to move in the longitudinal direction of the bearing pin 67, the hole 68, into which the bearing pin 67 is fitted, in the actuating members 33*a* and 33*b* being in the form of a slot.

In the working embodiment illustrated the deflection movement is limited by the head 70 of the bearing pin 67, which furthermore may serve to act as a supporting abutment for spring means which are not illustrated in detail and which bias the abutment part 38 into the non-deflected position by action on the actuating members 33*a* and 33*b*.

During the deflection movement therefore practically the abutment part 38 and furthermore the length sections, adjoining it, of the actuating members 33*a* and 33*b* are pivoted out of that plane, in which they are located during closing operation or during the obstructing action.

Figure 13:
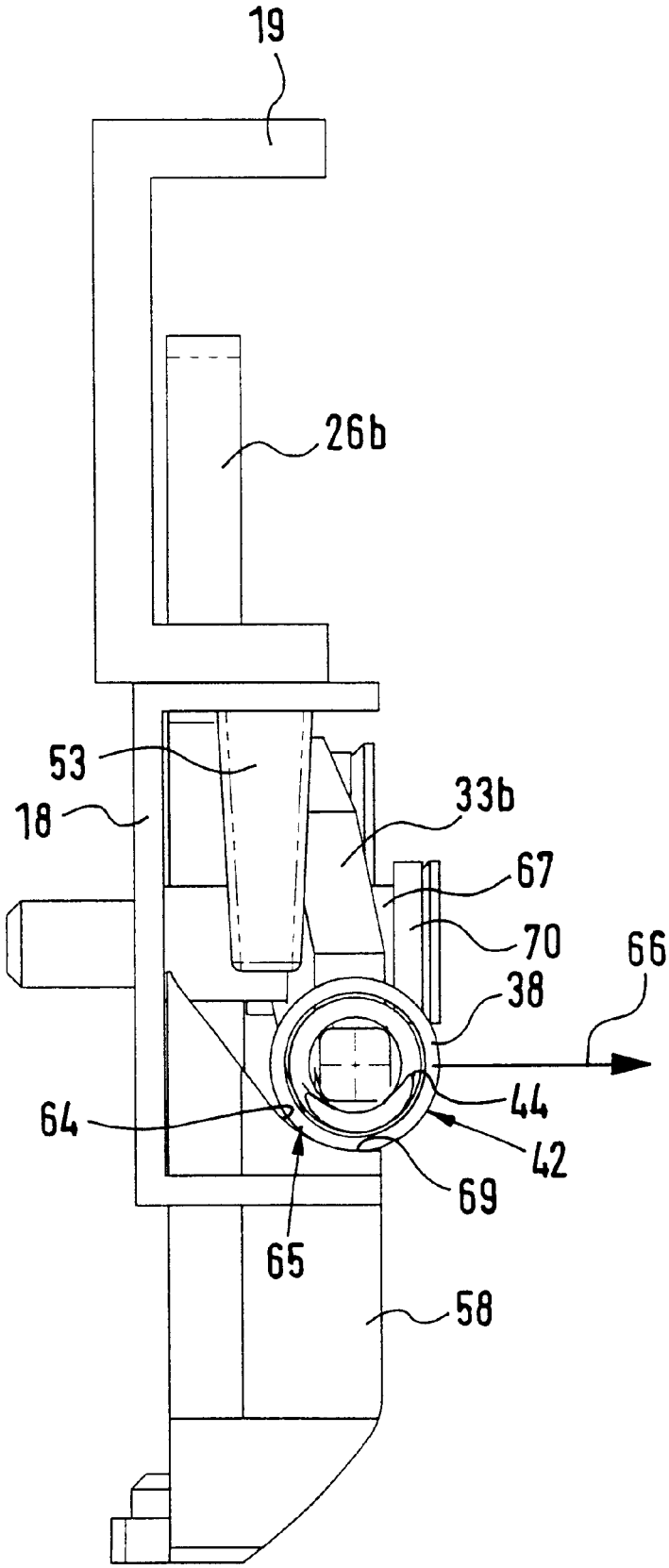
FIGS. 13 to 15 show the states of the closure device of FIGS. 10 through 12 in an end-on view similar to that of FIGS. 6 through 9.

In this deflected position in this case FIG. 13 the abutment part 38 is able to move past to the face side of the obstructing member 53. The actuating members 33*a* and 33*b* may consequently be pivoted back by the obstructing member 53 out of the closed position into the open position, the pivoting motion taking place solely outside the pivotal plane relevant for the switching over into the closed position.

It would now be possible in principle to provide spring means to effect an automatic return into the open position after the deflection of the abutment part 38. Since however spring means are liable to failure, the design in accordance with the embodiment of the invention provides not only for a manually activated deflection operation but also for a manually effected return switching movement.

In this connection the opener is provided on its activating member 58 additionally with a strike face 69, facing the abutment part 38, which takes effect after the deflection of the abutment part 38. In the working embodiment illustrated it adjoins the deflecting face 64 and extend athwart the direction 63 of activation.

Figure 14:
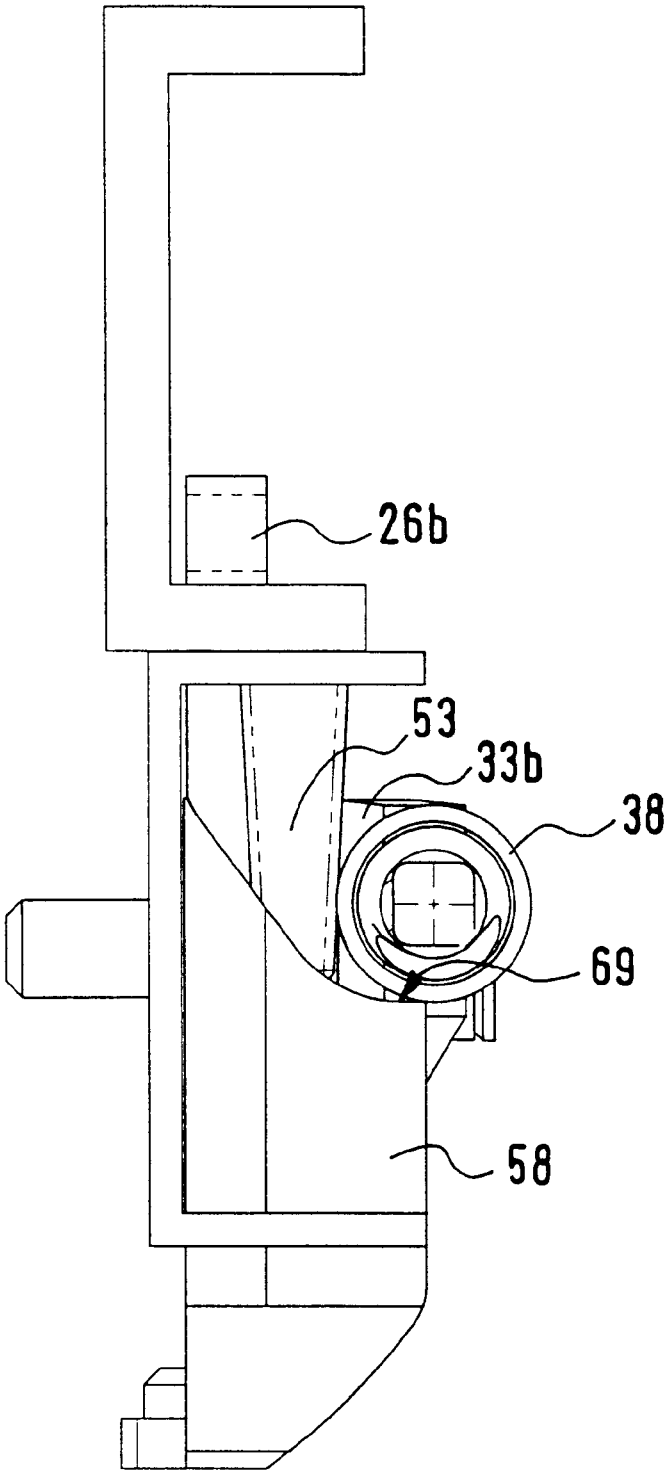

If now the opener 57 is caused to perform an opening movement toward the obstructing member 53, the abutment part 38 will be firstly shifted by the deflection face 64 into the deflected position as described and then moved past the obstructing member 53 by the following strike face 69. The last named condition is illustrated in FIG. 14.

Owing to the spring means 42, which in the working example of the invention produce a bistable resilient locking effect, in the present case it is unnecessary to actively or positively move the abutment part 38 right as far as the position open position. After the abutment part 38 has moved past the above mentioned connecting line 55 (dead center), the return motion after the remainder of the return path is caused by the snap action effect.

Figure 15:
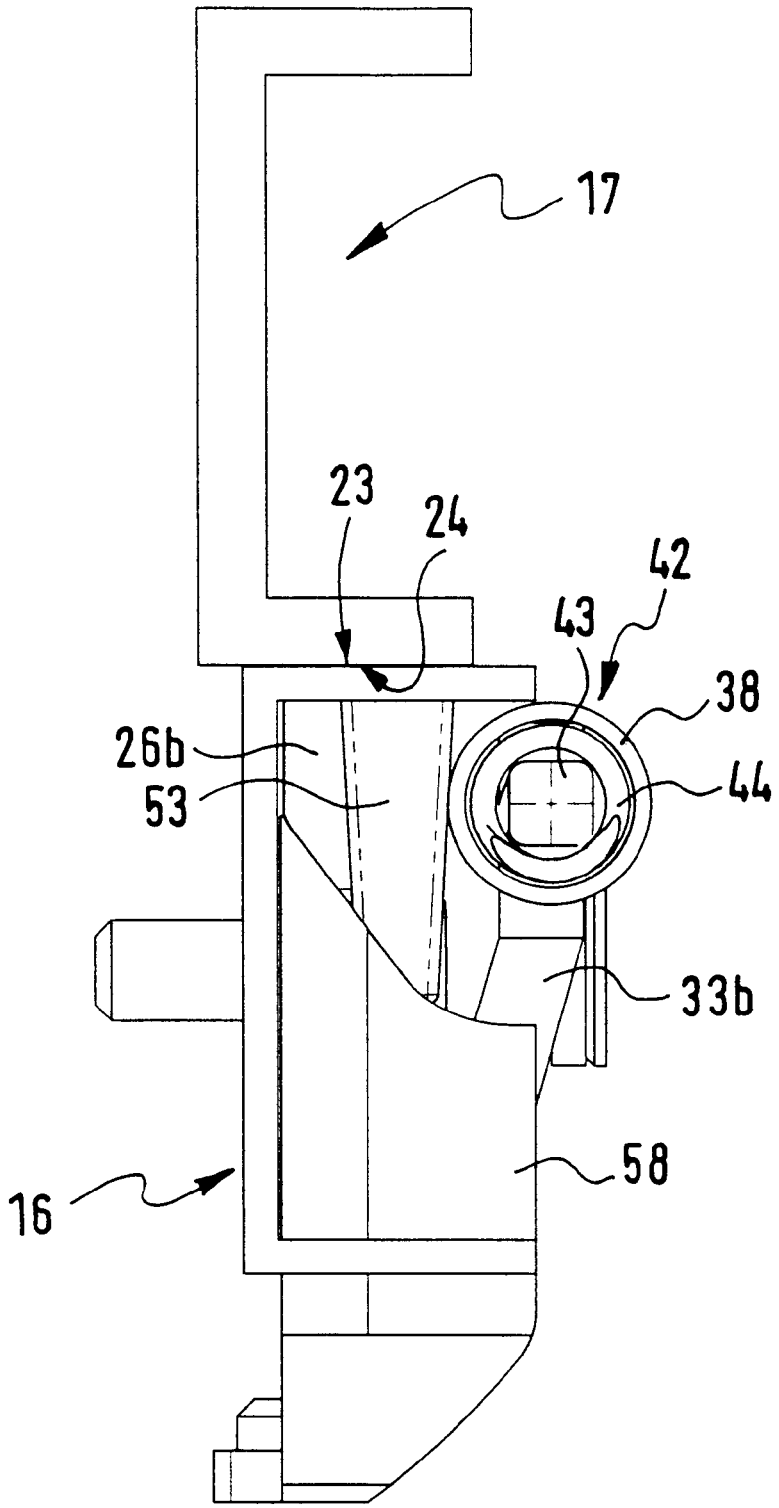

Thus finally we will have the unlocked state depicted in FIGS. 12 and 15, in the case of which the actuating members 33*a* and 33*b* are switched over into the open position despite the obstructing member 53 constantly being in the obstructing position, something which simultaneously results in movement into the released position of the first engagement members 26*a* and 26*b*. The container can now be opened, the locking instrumentalities 16 and 17 being moved apart from each other and the obstructing member 53 ceasing its engagement with the first locking instrumentalities 16 so that finally the abutment part 38, which so far has been deflected, together with the actuating members 33*a* and 33*b*, which so been deflected as well may return into the non-deflected position. In order to aid such return motion the above mentioned spring means may be provided.

Figure 10:
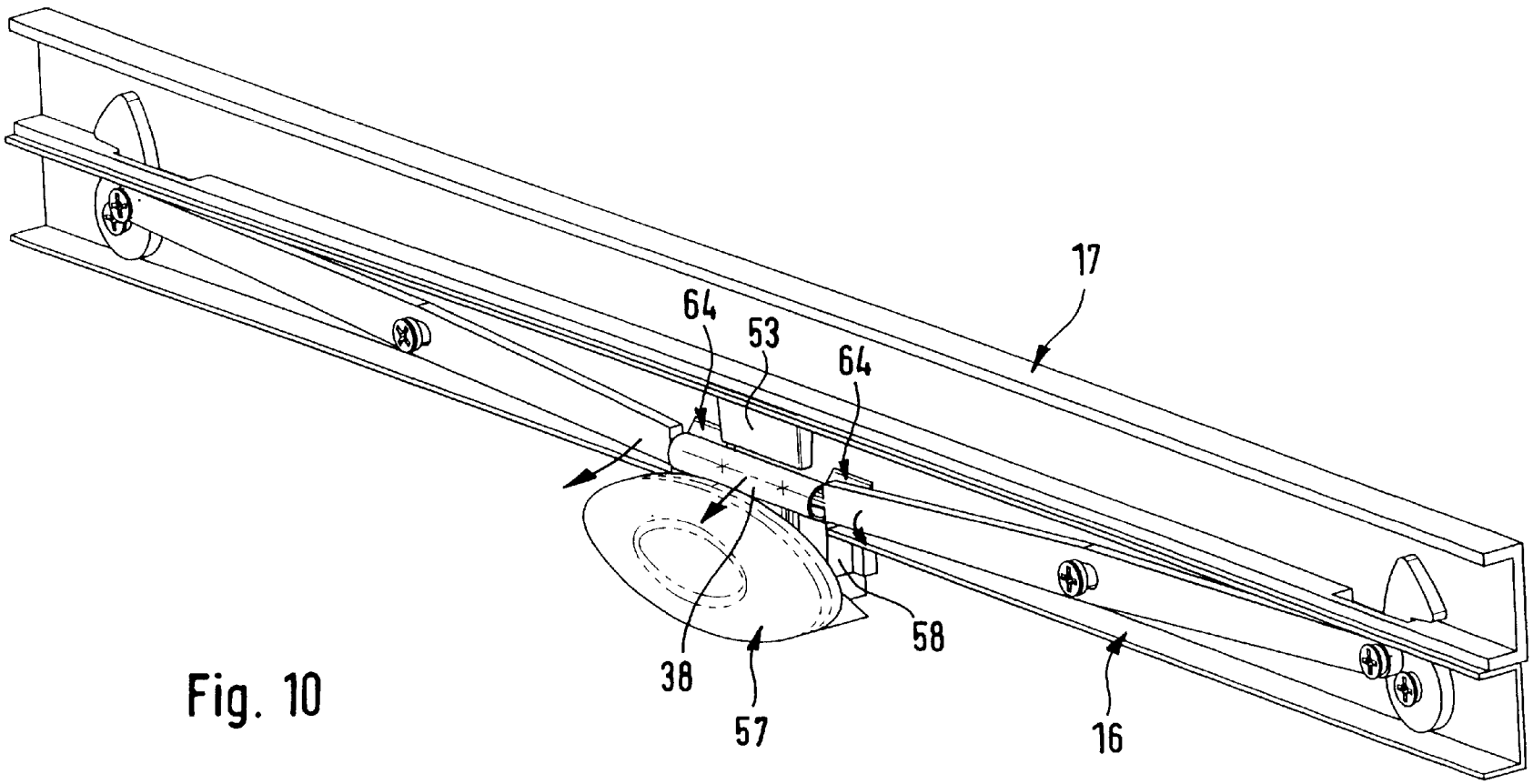
FIGS. 10 and 11 show of the opening operation of the closure device in a perspective representation corresponding to that of FIGS. 2 through 5.
Figure 11:
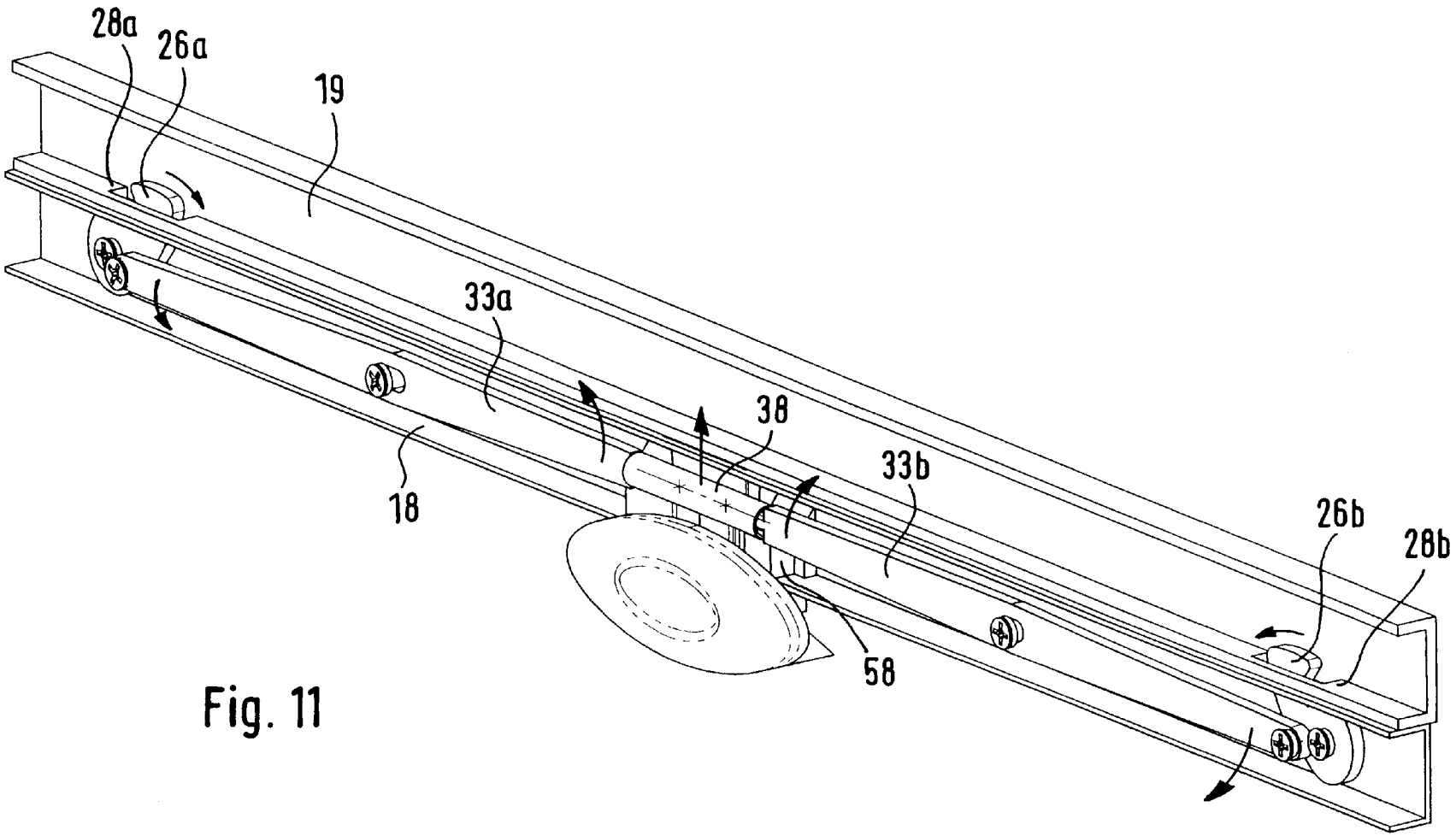

The overall course of the unlocking operation of the closure device or lock will be seen from the individual phases as indicated in the FIGS. 10 through 12 or, respectively, 9 and 13 through 15.

There is the possibility, which is not indicated in the figures, of aiding the clearance of the locking instrumentalities 16 and 17 during the unlocking operation in order, by actuation of the opener 57, to cause a slight opening of the container 1 so that there is simply a narrow gap between the container parts. For this purpose it is possible for the opener 57 to be fitted with at least one actuation face, which in the switching over phase following deflection phase acts on the obstructing member 53 so that the latter is lifted at least to a partial extent out of the first locking instrumentalities 16.

While in the working example a slide-like opener 57 is employed, it is to be noted that alternatively and for example other designs could be utilized having actuation by eccentric means or by a thrust. The opener can furthermore be biased by suitable spring means into its deactivated position.

Figure 16:
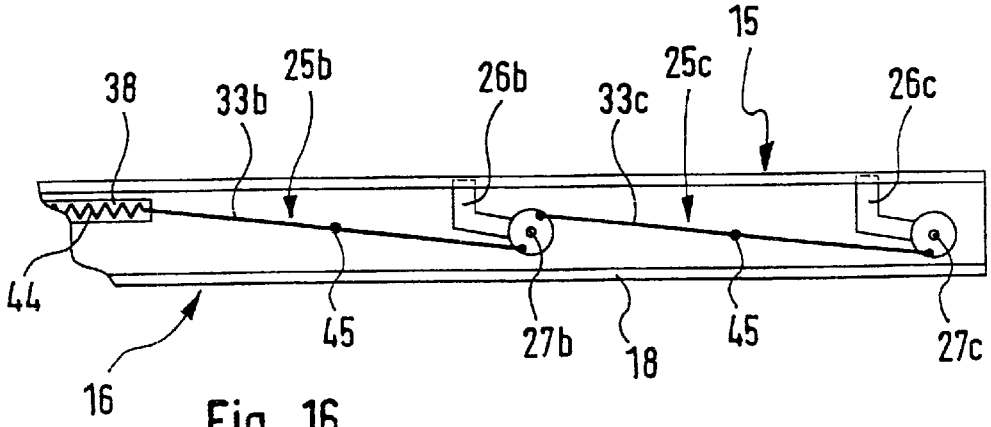
FIG. 16 show a diagrammatic representation of part of the first locking instrumentalities in a further embodiment of the closure device looking in the direction of the arrow A of FIG. 1.

FIG. 16 shows a further possible design of the first locking instrumentalities 16, in the case of which a plurality of locking units 25*b* and 25*c*, switched directly in a row, are provided. It is the actuating member 33*b* of the one locking unit 25*b* which is here provided with an abutment part 38 and the actuation of the pivoting axis 27*c* of the following further locking unit 25*c* is performed directly by the first locking unit 25*b*. This is for example something which may be accomplished if the actuating member 33*c* of the following locking unit 25*c* is provided on the first engagement member 26*b* of the preceding locking unit 25*b* and is driven by the pivoting movement thereof to perform its own pivotal movement, which is then transmitted to the associated first engagement member 26*c*.

In the case of this design it is extremely simple to vary the number of the first engagement members for adaptation to suit different dimensions of the container to be fitted.

Departing from the identical lever proportions in the working example so far described within the individual locking units it is readily possible, if required, to have different lever ratios.

While the closure devices illustrated in the figure have two or more locking units, the there is naturally enough the possibility of fitting the closure device with only a single locking unit or of fitting a container simultaneously with several locking units to be operated separately.

The closure device of the working embodiment is so designed that same may be relatively simply attached to a container. However, it would certainly be possible to integrate the closure device at least partially permanently in a container, for example by integrating the function of the first and second beams 18 and 19 in a frame or a wall of the container. For instance, stiffening ribs, which are in any case necessary, could constitute the beams.

Finally it is to be mentioned that the closure device may, if appropriate, comprise a safety catch means 73 in addition to the locking means, which independently from the obstructing member 53 provides a safety catch function to prevent unauthorized unlocking of the first engagement members 26*a* and 26*b*. This safety catch means 73, which is preferably in the form of a number lock, is preferably so designed that it cooperates with the opening mechanism 56 and for instance prevents actuation of the opener 57.

What is claimed is:

1. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position.

2. The closure device as set forth in claim 1, wherein the opening mechanism comprises an adjustable opener having a deflecting face, which is more particularly oblique, by means of which the abutment part may be so acted upon that same is deflected in relation to the obstructing member and the obstructing member may move past to the side for switching over the actuating member into the open position.

3. The closure device as set forth in claim 2, wherein the abutment part is biased by spring means into the non-deflected position thereof.

4. The closure device as set forth in claim 2, wherein the adjustable opener possesses a strike face and for opening the associated container can be caused to perform an opening movement, in the case of which it firstly moves the part by means of the deflecting face into a deflected position and then moves it past the obstructing member in order to positively move the actuating member into the open position.

5. The closure device as set forth in claim 4, wherein the opener is so designed that in the switching over phase following the deflection phase it acts on the obstructing member and lifts such member at least partially out of the first locking instrumentalities.

6. The closure device as set forth in claim 2, wherein the deflecting face is oblique.

7. The closure device as set forth in claim 1, wherein at least one obstructing member of the second locking instrumentalities projects like pin or a lug toward the first locking instrumentalities.

8. The closure device as set forth in claim 7, wherein the first locking instrumentalities have an opening associated with the respective obstructing member, into which opening the obstructing member can plunge when the locking instrumentalities are united.

9. The closure device as set forth in claim 1, wherein at least one first engagement member is mounted for pivotal movement and during the transition from the release position and the locking position performs a pivotal movement.

10. The closure device as set forth in claim 1, wherein at least one first engagement member is designed like a hook, the at least one second engagement member being constituted by the edge of an opening in the second locking instrumentalities, which is hooked around by the hook-like first engagement member in the locking position.

11. The closure device as set forth in claim 1, wherein on the side, facing the second locking instrumentalities, the first locking instrumentalities possess a terminal face defined for instance by the outer face of a bar of constant cross section, which at least partly covers the locking mechanism and behind which the at least one first engagement member is set back in the release position, each first engagement member being provided with a recess, through which it may be moved for assuming the locking position.

12. The closure device as set forth in claim 1, comprising spring means holding the at least one first engagement member in the release position.

13. The closure device as set forth in claim 12, wherein the spring means holds the at least one first engagement member in the release position by engaging and holding the actuating member in the open position.

14. The closure device as set forth in claim 12, wherein such spring means are so designed that they cause a bistable holding of the actuating member in the open position and in the closed position.

15. The closure device as set forth in claim 1, wherein the at least one obstructing member of the second locking instrumentalities constitutes a strike member, which when the locking instrumentalities are moved together acts on the associated abutment part of the actuate member located in the open position and switches it over into the closed position.

16. The closure device as set forth in claim 1, wherein the at least one obstructing member and the at least one second engagement member are designed in the form of independent components of the second locking instrumentalities.

17. The closure device as set forth in claim 1, wherein the first locking instrumentalities comprise several locking units, which respectively comprise an actuating member and at least one first engagement member cooperating with the same.

18. The closure device as set forth in claim 17, wherein the locking units have a first common opening mechanism.

19. The closure device as set forth in claim 17, wherein a plurality of locking units are connected directly in series.

20. The closure device as set forth in claim 17, wherein two adjacently placed locking units are provided, the opening mechanism is associated with the intermediately placed portion and simultaneously is able to cooperate with the two locking units.

21. The closure device as set forth in claim 1, wherein the at least one actuating member is designed in the form of a pivotally mounted lever having a first arm and a second lever arm, the first arm cooperating with a first engagement element and the second lever arm being provided with an abutment part.

22. The closure device as set forth in claim 21, wherein two adjacently placed locking units are provided, the opening mechanism is associated with an intermediately placed portion and simultaneously is able to cooperate with the two locking units wherein the at least one actuating member is designed in the form of a pivotally mounted lever, whose first arm cooperates with a first engagement and wherein between the two mutually adjacent second lever arms of two adjacent locking units coupling means extend which simultaneously engage the two second lever arms and which during a synchronous switching movement of the actuate members perform a translatory movement.

23. The closure device as set forth in claim 22, wherein the coupling means comprise an abutment part associated with both actuating members and which can cooperate with an obstructing member.

24. The closure device as set forth in claim 22, wherein the coupling means comprise spring means, which bear against the second lever arms and are placed between them, and accordingly bias the actuating means simultaneously in the opening direction or respectively in the closing position.

25. The closure device as set forth in claim 21, wherein the opening mechanism comprises a slide-like opener, which is able to be moved more particularly linearly in a working plane for acting on the abutment part, which working plane coincides or is parallel to the pivotal planes of the actuate members.

26. The closure device as set forth in claim 21, wherein the abutment part is able to be deflected for overriding the obstructing action in a direction athwart the pivotal plane of the actuating members.

27. The closure device as set forth in claim 1, comprising at least one safety catch means having for example a number lock for securing the at least one first engagement member to prevent unauthorized unlocking, such catch means preferably cooperating with the opening mechanism.

28. A container comprising two container parts and with a closure device as set forth in claim 1.

29. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position;

wherein the opening mechanism comprises an adjustable opener having a deflecting face by means of which the abutment part may be so acted upon that same is deflected in relation to the obstructing member and the obstructing member may move past to the side for switching over the actuating member into the open position.

30. The closure device as set forth in claim 29, wherein the container is a traveling or tool case.

31. A container comprising two container parts and with a closure device as set forth in claim 29.

32. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position;

comprising spring means holding the at least one first engagement member in the release position, preferably by same engaging the actuating member and holding same in the open position.

33. A container comprising two container parts and with a closure device as set forth in claim 32.

34. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position, wherein the at least one actuating member is designed in the form of a pivotally mounted lever, whose first arm cooperates with a first engagement element and whose second lever arm is provided with an abutment part, wherein two adjacently placed locking units are provided, the opening mechanism is associated with the intermediately placed portion and simultaneously is able to cooperate with the two locking units wherein the at least one actuating member is designed in the form of a pivotally mounted lever, whose first arm cooperates with a first engagement and wherein between the two mutually adjacent second lever arms of two adjacent locking units coupling means extend which simultaneously engage the two second lever arms and which during a synchronous switching movement of the actuate members perform a translatory movement; and wherein the coupling means comprise spring means, which bear against the second lever arms and are placed between them, and accordingly bias the actuating means simultaneously in the opening direction or respectively in the closing position.

35. A container comprising two container parts and with a closure device as set forth in claim 34.

36. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position;

wherein the at least one actuating member is designed in the form of a pivotally mounted lever, whose first arm cooperates with a first engagement element and whose second lever arm is provided with an abutment part; and wherein the opening mechanism comprises a slide-like opener, which is able to be moved more particularly linearly in a working plane for acting on the abutment part, which working plane coincides or is parallel to the pivotal planes of the actuate members.

37. A container comprising two container parts and with a closure device as set forth in claim 36.

38. A closure device for a container comprising a locking means for the releasable mutual locking of two container parts when the container is closed, said locking means having first locking instrumentalities for a first container part and second locking instrumentalities for a second container part, the first locking instrumentalities including at least one actuating member able to be switched over between an open position and a closed position, said actuating member being kinematically coupled with at least one engagement member of the first locking instrumentalities, which in the open position of the actuating member can assume a released position out of a locking engagement with a second engagement member of the second locking instrumentalities and in the closed position of the actuating member can assume a locking position in locking engagement with the second engagement member, the second locking instrumentalities comprise at least one obstructing member extending, when the locking instrumentalities are united together, into a path of displacement of an abutment part constituted directly by the actuating member or kinematically coupled with same and holds the actuating member in the closed position and an opening mechanism is provided by means of which the obstruction of the actuating member may be overridden and the actuating member may be switched over back into the open position;

wherein the at least one actuating member is designed in the form of a pivotally mounted lever, whose first arm cooperates with a first engagement element and whose second lever arm is provided with an abutment part; and wherein the abutment part is able to be deflected for overriding the obstructing action in a direction athwart the pivotal plane of the actuating members.

39. A container comprising two container parts and with a closure device as set forth in claim 38.

* * * * *